United States Patent [19]

Ferguson

[11] Patent Number: 4,489,910

[45] Date of Patent: Dec. 25, 1984

[54] MOUNTING BRACKET FOR TRAFFIC SIGNAL INSTALLATION

[76] Inventor: Joseph D. Ferguson, 909 Fern Hill Rd., West Chester, Pa. 19380

[21] Appl. No.: 381,405

[22] Filed: May 24, 1982

[51] Int. Cl.[3] ..... A47B 96/06

[52] U.S. Cl. ..... 248/219.4; 248/231; 248/278; 248/279; 248/284; 340/119; 362/431

[58] Field of Search ..... 248/279, 286, 284, 230, 248/231, 242, 222.1, 278, 214, 219.4; 340/119; 362/431

[56] References Cited

U.S. PATENT DOCUMENTS

| | | | |
|---|---|---|---|
| 2,123,695 | 7/1938 | Elmer | 248/230 |
| 2,663,531 | 12/1953 | Rubano | 248/231 |
| 3,005,614 | 10/1961 | Daniell | 248/230 |
| 3,026,072 | 3/1962 | Hughes | 248/231 X |
| 3,586,280 | 6/1971 | Parduhn . | |
| 3,764,099 | 10/1973 | Parduhn . | |
| 3,977,641 | 8/1976 | Garchinsky . | |
| 4,010,925 | 3/1977 | Garchinsky . | |
| 4,148,456 | 4/1979 | Garchinsky . | |

FOREIGN PATENT DOCUMENTS

| | | | |
|---|---|---|---|
| 6503140 | 9/1966 | Netherlands | 248/242 |

*Primary Examiner*—J. Franklin Foss
*Assistant Examiner*—David L. Talbott
*Attorney, Agent, or Firm*—Dann, Dorfman, Herrell and Skillman

[57] ABSTRACT

A mounting bracket for installing traffic signals. The signal housing is mounted between two support arms extending outwardly from a post which is coextensive with and parallel to the signal housing. A sleeve is mounted on the post for adjustment along the axis of the post for adjustment both axially and circumferentially thereon. Locking means, preferably set screws, is provided to anchor the sleeve on the post in adjusted position. The sleeve has a hanger plate extending outwardly therefrom generally parallel to the post, and the plate has a stub shaft projecting from both surfaces of the plate, preferably at right angles thereto. An aperture is provided in spaced relation to the stub shaft for receiving a locking bolt. The hanger plate is engageable with a hook member designed to be mounted on the traffic standard at a desired position by means of mounting straps which circumscribe a component of the standard and the hook member, thereby anchoring the member firmly on the traffic standard, either on the upright or on the cross arm thereof. The hook member comprises a cradle base adapted to be mounted flush against the standard and a support piece extending outwardly therefrom. The support piece has an open-ended recess forming a hook for receiving the free ends of the stub shaft of the hanger plate. An arcuate slot is disposed below the bottom of the recess to accommodate the locking bolt affording angular adjustment of the sleeve on the stub shaft when it is seated at the bottom of the recess. The support piece and the cradle base of the hook member are adjustable to accommodate different angular orientations of a cross arm on the traffic standard.

12 Claims, 8 Drawing Figures

MOUNTING BRACKET FOR TRAFFIC SIGNAL INSTALLATION

FIELD OF THE INVENTION

The present invention relates to an assembly for mounting a signal housing on a traffic standard, and more particularly a mounting bracket which facilitates the installation and adjustment of the signal housing on the standard for proper aiming of the signals.

BACKGROUND OF THE INVENTION

The mounting and maintenance of traffic signals on highways is regulated by the traffic code of the jurisdiction having control over the highway. In most instances the codes require at least one signal at the side of the highway and at least one signal over the travelway of the highway. Due to accidents or oversize loads, the signals frequently are damaged or are knocked askew and require periodic adjustment and/or replacement and repair. Furthermore, when signals are inoperative for a prolonged period, most codes require the signals to be bagged or adjusted to make it obvious that they are not functioning for control purposes, for example by facing the signal housing so that the lenses do not confront the traffic.

Particularly with directional lenses, signals must be accurately aimed so that they may be seen by the approaching traffic at a sufficient distance from the signal to permit safe stopping of the traffic. The aiming of the signals is particularly significant when the approach to the signal is at a steep grade or on a curve.

Adjustable mounting assemblies have been available for many years, as evidenced by U.S. Pat. Nos. 3,586,280; 3,764,099; 3,977,641; 4,010,925 and 4,148,456. A major drawback of these prior mounting brackets is the need for two mechanics at the signal housing in order to effectively adjust the housing to meet the requirements of the particular installation.

SUMMARY OF THE INVENTION

The present invention provides an improved mounting bracket which facilitates the installation and maintenance of the traffic signal. The mounting bracket permits installation and adjustment of the signal housing by a single mechanic at the housing.

More specifically, the present invention provides a mounting bracket which incorporates a hook-like support piece cooperating with a hanger element and designed to enable the signal housing to be safely suspended on the traffic standard without danger of it falling as the fine adjustments to the orientation of the housing are accomplished.

In accordance with the invention, the support piece for the hanger includes an open-ended recess defining a hook for receiving the hanger, guide walls providing lateral support for the hanger and an arcuate slot having a center of curvature coincident with the bottom of the open-ended recess so that when the hanger is fully engaged in the recess the angular orientation may be adjusted by selective anchoring of the hanger along the full length of the arcuate slot.

BRIEF DESCRIPTION OF THE DRAWINGS

All of the objects of the invention are more fully set forth hereinafter with reference to the accompanying drawing wherein.

DESCRIPTION OF THE PREFERRED EMBODIMENT

Figure 1:
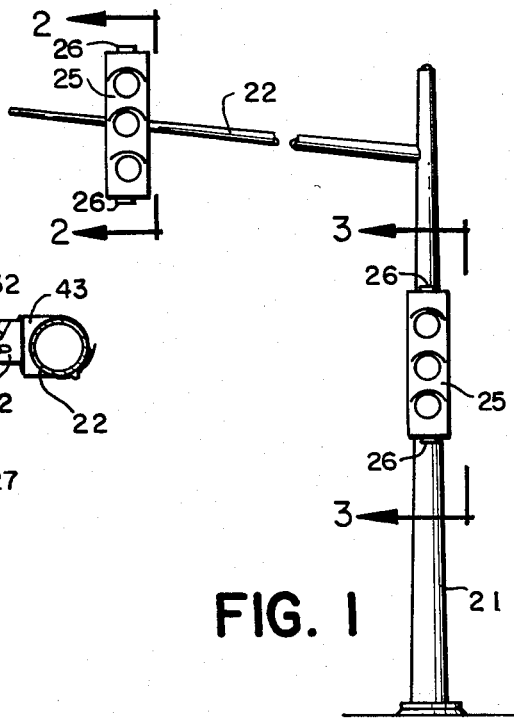
FIG. 1 is a sketch showing a typical traffic light installation embodying mounting brackets made in accordance with the invention.

With reference to the drawings, FIG. 1 illustrates a typical installation wherein the traffic light standard includes an upright pole 21 positioned at the curb line of the highway having a cross arm 22 extending over the highway. In most jurisdictions, the Highway Code requires a signal at about eight feet above grade at the curb line and a second signal preferably centered over the travelling lane of the roadway. By using an inverted L-shaped standard as shown, the necessary signals may be mounted on the single standard. In the present instance the standard is shown composed of hollow tubular members having circular cross sections with a gradual taper away from the base, but other constructions of standards may be employed, depending upon the procurement policies of the department or agency responsible for installation of the traffic signals. Thus it is desirable to provide a mounting bracket which may be accommodated to a wide variety of standards.

Figure 2:
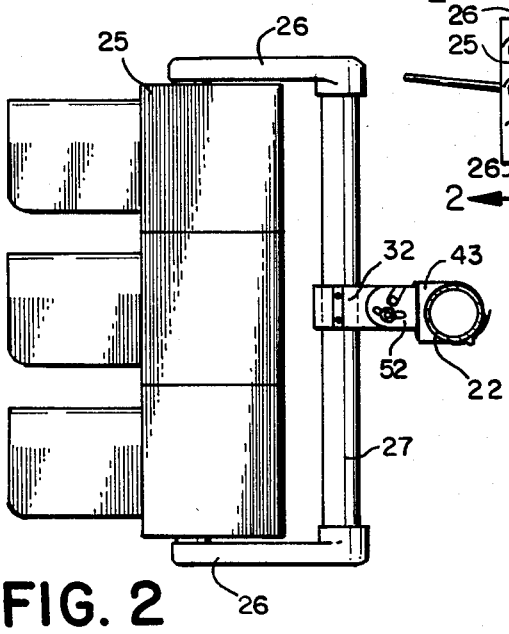
FIGS. 2 and 3 are enlarged sectional views taken along the lines 2—2 and 3—3, respectively, of FIG. 1.
Figure 3:
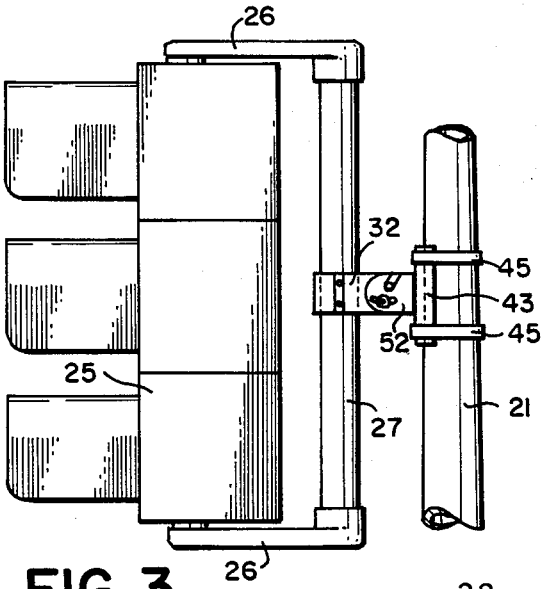

The mounting bracket of the present invention is particularly adapted for use with standard signal housings, such as illustrated at 25 in FIGS. 1–3. In the present instance, the signal housing 25 comprises three signal sections, each including a case, a lamp, a lense and a shield with appropriate wiring which may extend through the back of the case or may be threaded through the mounting apertures at the top and the bottom. The most common configuration of the signal housing consists of three or four cases stacked vertically, but it is not uncommon to employ signal housings in which the cases are stacked horizontally alongside one another or are arranged in clusters. In the illustrated embodiment the signal housing has mounting apertures at the top and bottom so as to be supported between support arm 26 which extend parallel to one another from the opposite ends of a post 27 extending the full length of the signal housing and spaced parallel thereto. The arms are normally engaged with the signal housing so that the post 27 is disposed rearwardly of the signal housing, as shown, but the arms permit the post to be positioned at various angular orientations circumferentially of the signal housing axis. The support arms are channeled to permit passage of the wiring for the signal therethrough and the post 27 is preferably hollow to afford threading of the wiring centrally therethrough. Although not shown in the drawings, the wiring passes from the post to the traffic standard at the point where the post is mounted on the standard.

Figure 8:
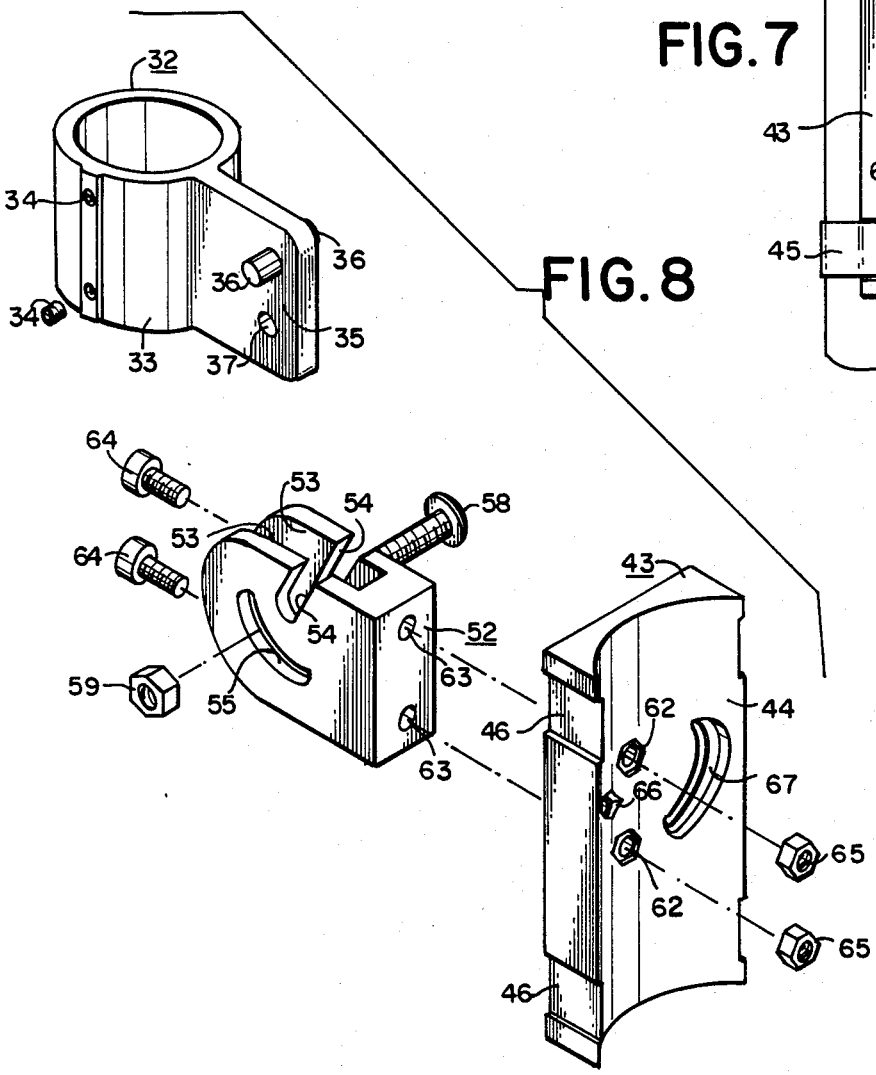
FIG. 8 is an exploded perspective view of the mounting bracket.

In accordance with the present invention the post 27 is mounted on the standard by bracket means affording substantially universal adjustment of the signal housing. To this end the mounting bracket for the post 27 includes a hanger member 32 which is adjustably mounted on the post 27 so as to enable the member to be positioned at any desired point along the length of the post. Preferably the hanger member is also adjustable circumferentially of the post so as to permit angular adjustment about the axis of the member. As best shown in FIG. 8, the hanger member comprises a mounting portion 33 consisting of a hollow cylindrical portion having an internal diameter corresponding to the external diameter of the post 27 so as to afford a sliding fit between the cylindrical portion 33 and the post 27. The sliding fit permits both axial and circumferential adjustment of the member 32 and the hanger member may be anchored in any desired position by suitable anchoring means, in the present instance set screws 34. In the present instance the set screws are seated in a single boss on the cylindrical portion, but if desired, bosses may be provided at two positions which are spaced apart 90° about the circumference of the cylindrical portion 33. When the sliding fit of the portion 33 is sufficiently snug, the set screws at a single position are totally effective. The slide 32 also has a hanger plate 35 projecting wing-like radially from the cylindrical sleeve 33. The plate adjacent its outer extremity has a stub shaft 36 extending through the plate and secured thereto, with free ends projecting perpendicular to the plate on opposite surfaces thereof. Underlying the stub shaft 36 in vertical registry therewith is an aperture 37.

The hanger member 32 is adapted to engage a hook member 42 mounted on the traffic standard. The hook member 42 includes a mounting portion 43 consisting of a cradle base having an arcuate surface 44 confronting the traffic standard and adapted to be securely seated against the traffic standard by a pair of mounting straps 45,45 engaged in grooves 46 around the exposed surface of the base. The straps are secured by conventional buckles 47, (see FIG. 6) which are clinched in place to firmly mount the base on the standard at the desired position, the grooves 46 resisting dislodgment of the base from the straps. The arcuate surface 44 provides a firm seat on either the upright 21 or the cross arm 22 of the standard where the diameter of the standard is equal to or greater than the diameter of the arcuate surface 44. If the diameters are equal, there is a surface-to-surface contact between the mounting portion 43 and the standard. If the diameter of the standard is greater than that of the surface 44, there is a line contact along the opposite edges. If it is desired to provide a surface-to-surface contact, a filler piece may be provided to adapt the curvature of the surface 44 to the curvature of the element of the standard to which it is mounted.

Projecting outwardly from the base 43 between the grooves 46,46 is a support piece 52 which forms the hook for engaging the stub shaft 36 of the sleeve 32. The support piece 52 is bifurcated to provide confronting guide walls 53,53 between which the hanger plate 35 is slidably received. The guide walls have in their upper surface open-ended recesses 54 which combine to form the bight of the hook receiving the stub shaft 36. The width of the recesses 54 in the guide walls 53 corresponds substantially to the diameter of the stub shaft so that the shaft is snugly received in the open-ended recess 54. As shown, the recess 54 is sloped downwardly and outwardly from the base so as to releasably retain the stub shaft when it is engaged therein. By this construction, with the sleeve anchored on the signal housing, the assembly may be hooked into the recess 54 and the weight of the signal assembly will retain the stub shaft within the recess at its bottom.

Below the bottom of the recess, the support piece is provided with arcuate slots 55 in the guide walls 53 which register with one another and also register with the aperture 37 when the stub shaft 36 is bottomed in the recess 54. The slots 55 have a center of curvature coincident with the bottom of the recess 54 so that when the hanger plate 35 is adjusted angularly on the stub shaft 36 as an axis, the aperture 37 is maintained in registry with the slots 55 in the guide walls 53. A fastener 58 may then penetrate the slots 55 and the aperture 37 and serve to anchor the hanger plate at any desired angular position within the range of adjustment afforded by the arcuate slots 55. In the present instance the fastener 58 comprises a locking bolt having a lock nut 59 cooperable therewith to anchor the hanger plate in the desired angular orientation on the pivotal axis afforded by the stub shaft 36.

With reference to FIG. 3, it is apparent that the hook and hanger arrangement of the present invention enables the signal housing 25 to be adjusted angularly about the stub shaft 36 to enable aiming of the signal housing to accommodate for different grades in the approach to the signal. By adjusting the hanger member 32 angularly on the post 27 the signal housing 25 may be adjusted about a vertical axis to accommodate curves in the highway approach to the signal or different angular orientations of the cross arm relative to the highway. By adjusting the member 32 vertically on the post 27, the elevation of the signal 25 may be adjusted. Thus the signal is universally adjustable. By reason of the hook and hanger engagement, the signal housing assembly is supported while the adjustments may be made, thereby enabling the adjustments to be made by a single mechanic at the traffic signal. Normally the angular adjustment on the stub shaft 36 is the most critical adjustment and this may be accomplished by a single mechanic without need for a helper to support the weight of the signal as the adjustment is made. With this adjustment made, the angular adjustment of the signal head on the vertical axis is also readily accomplished by a single mechanic.

Figure 4:
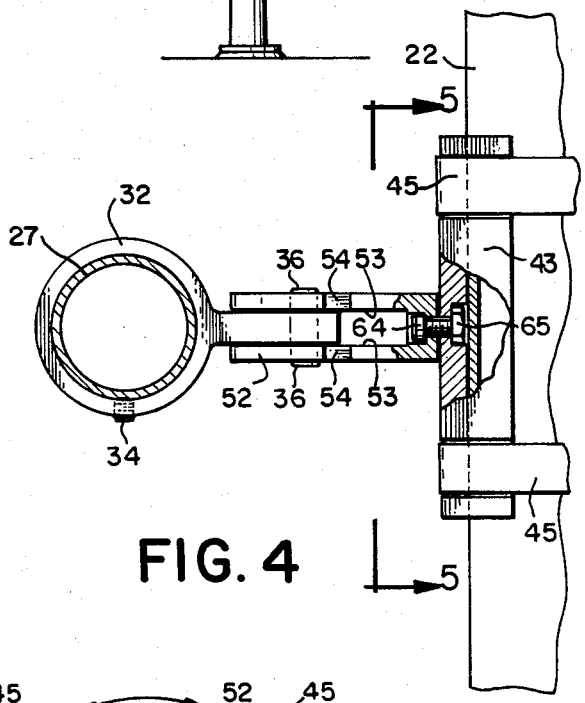
FIG. 4 is a horizontal sectional view as seen from above the overhead mounting bracket of FIG. 2, with portions broken away to more clearly illustrate its construction and assembly.
Figure 5:
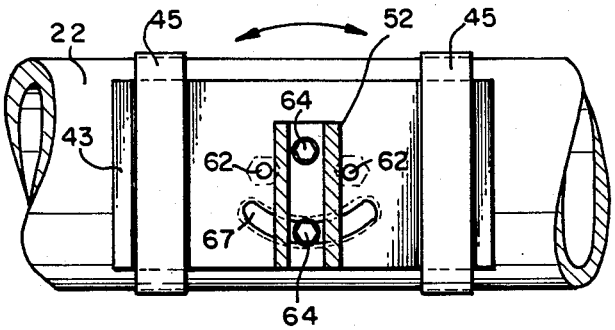
FIG. 5 is a sectional view taken on the line 5—5 of FIG. 4.
Figure 6:
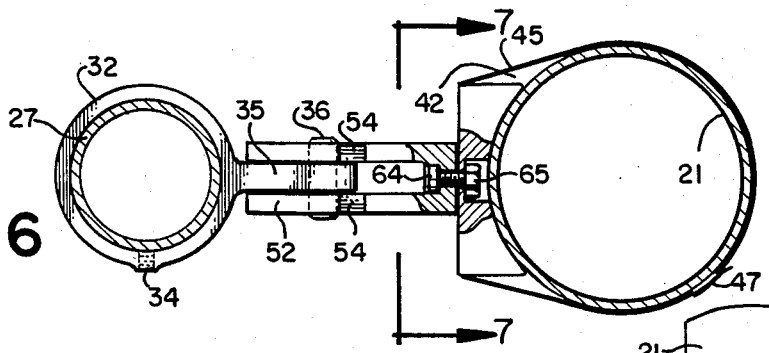
FIG. 6 is a horizontal sectional view as seen from above the pole-mounted bracket of FIG. 1 with portions broken away to illustrate its construction and assembly.
Figure 7:
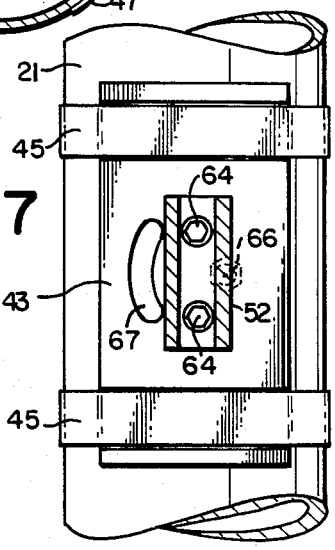
FIG. 7 is a sectional view taken on the line 7—7 of FIG. 6.

In the illustrated embodiment of the invention, the same parts may be used for mounting on the upright 21 as are used for mounting on the cross arm 22. To this end, the support piece 52 is adapted to be mounted on the cradle base 43 in either one of two positions. When mounted as shown in FIGS. 3, 6 and 7, the guide walls 53 are disposed longitudinally of the cradle base. To effect the interconnection in this fashion, as shown in FIG. 8, the support piece 52 is fastened to the base 43 by means of longitudinally-aligned bolt holes 62,62 which are dimensioned to register with sockets 63,63 in the support piece 52. The sockets are opened to the space between the guide walls 53,53 so as to permit the insertion of socket screws 64 through the support piece 52 and the base 43 to engage nuts 65,65 which are adapted to seat within countersunk portions of the apertures 62,62. When mounted as shown in FIGS. 2, 4 and 5, on the other hand, the support piece 52 is mounted on the base by a first aperture 66 and an arcuate slot 67 which are similarly countersunk. Securing the support piece 52 on the base 43 with the apertures 66 and 67 permits the support piece to be oriented transversely to the base at varying angles to accommodate different angular orientations of the cross arm 22 relative to the highway. As shown in FIG. 5, the socket screws 64 engage through the bottom of the support piece 52 into the apertures 66 and 67 and the arcuate form of the slot 67 permits angular adjustment of the support piece 52 relative to the base 43. Thus the illustrated construction permits the same base 43 to be used for mounting either on the cross arm 22 or the upright 21 with the signal housing vertical. If it is desired to mount the signal housing horizontally, a different sleeve may be used in which the hanger plate is disposed transversely to the axis of the sleeve rather than longitudinally thereof.

With the present construction, the bracket permits the traffic signal housing to be pivoted to a position where the lenses are not directed toward the traffic by a simple adjustment of the bracket. By displacing the signal housing to such inoperative position, the need for bagging the signal is obviated and consequently the need for continued surveillance of the inactive signal to ensure maintenance of the bagging is avoided. In accordance with the invention when the signals are reactivated, the readjustment of the signal housing to its proper orientation is done effectively and economically at a minimum expenditure of time and labor.

While a particular embodiment of the present invention has been herein illustrated and described, it is not intended to limit the invention to such disclosure but changes and modifications may be made therein and thereto within the scope of the following claims.

I claim:

1. A bracket for mounting a traffic signal on a traffic standard to afford adjustment of the orientation of the traffic signal, the bracket comprising a hanger member and a hook member, each having a mounting portion for attaching said member to one of the traffic signal and the traffic standard;

said hanger member having a hanger plate extending outwardly from said mounting portion, the hanger plate having shaft means projecting perpendicularly therefrom, said mounting portion positioning said hanger plate substantially vertical and said shaft means substantially horizontal;

said hook member having a support piece extending outwardly from said mounting portion thereof, the support piece having an open-ended recess therein, the recess forming a hook for receiving the shaft, said shaft adapted to seat in the bottom of said recess and support the signal on the standard and afford pivotal adjustment of signal about the horizontal axis of said shaft when seated, an arcuate slot means in said support piece spaced from said recess a predetermined distance and having a center of curvature coincident with the bottom of the recess and a radius of curvature corresponding to said predetermined distance; and fastener means carried by said hanger plate, in registry with the slot means when the shaft is bottomed in the recess, extending through the slot means to anchor the hanger plate in adjusted position relative to the support piece for fixing the position of the hanger member relative to the hook member when the shaft is seated in the bottom of recess.

2. The bracket as recited in claim 1 wherein said shaft projects from opposite surfaces of said hanger plate; and the support piece is bifurcated to include a pair of generally parallel guide walls spaced apart by at least the thickness of the hanger plate for receiving the hanger plate therebetween, the pair of guide walls having aligned open-ended recesses for receiving the opposite ends of the shaft therein.

3. The bracket as recited in claim 1 wherein the traffic signal includes a housing, generally parallel upper and lower supporting arms extending outwardly from the housing and a supporting post extending between the supporting arms and generally paralel to the housing; and wherein the mounting portion for attaching its member to the traffic signal comprises a sleeve having a hollow portion with an internal dimension corresponding to the external dimension of the supporting post, the sleeve being slidable on the supporting post for adjustment thereon, and having means to anchor it in adjusted position.

4. The bracket as recited in claim 3 wherein the sleeve is adjustible axially and angularly with respect to the supporting post.

5. The bracket as recited in claim 1 wherein the mounting portion for attaching its member to the traffic standard comprises:

a cradle base having an outer surface for seating engagement with the standard; and mounting straps at the opposite ends of the cradle base for securing the seated cradle base to the traffic standard at a desired position.

6. The bracket as recited in claim 5 wherein the cradle base further includes grooves at the opposite ends for receiving the mounting straps.

7. The bracket as recited in claim 5 wherein the outer surface of the cradle base is arcuate about an axis parallel to the longitudinal axis of said cradle base.

8. The bracket as recited in claim 7 including means attaching the support piece to the cradle base so the support piece extends along the longitudinal axis of said base.

9. The bracket as recited in claim 7 including means attaching the support piece to the cradle base to the support piece extends transversely to the longitudinal axis of said base.

10. The bracket as recited in claim 9 wherein said attaching means affords angular adjustment of the transverse position of said support piece.

11. The bracket as recited in any one of claims 8, 9 or 10 wherein said attaching means includes registering apertures in said base and support piece and socket screw fasteners passing through said apertures.

12. The bracket as recited in claim 7 including a pair of apertures in the support piece, apertures in the base, and fasteners passing through said apertures to attach the support piece to the base, the apertures in said base being in two pairs, one pair of base apertures registering with said support pair when said support piece extends longitudinally of said base, the second pair of base apertures registering with said support pair when said support piece extends transversely to the base.

* * * * *

UNITED STATES PATENT AND TRADEMARK OFFICE

CERTIFICATE OF CORRECTION

PATENT NO. : 4, 489,910

DATED : December 25, 1984

INVENTOR(S) : Joseph D. Ferguson

It is certified that error appears in the above-identified patent and that said Letters Patent is hereby corrected as shown below:

Claim 3, line 5, delete "paralel" and insert --parallel--.
Claim 9, line 2, delete "to" (second occurrence) and insert --so--.

Signed and Sealed this

*Seventh* Day of *May 1985*

[SEAL]

*Attest:*

DONALD J. QUIGG

*Attesting Officer*

*Acting Commissioner of Patents and Trademarks*